US006484661B2

(12) United States Patent
Stewart

(10) Patent No.: US 6,484,661 B2
(45) Date of Patent: Nov. 26, 2002

(54) HARD-TOP DESIGN INFLATABLE WATERCRAFT WITH ASSEMBLY FOR SHELTER AND CIRCUMFERENCE WALKING SUPPORT

(75) Inventor: Gregory Todd Stewart, Seal Beach, CA (US)

(73) Assignee: Louis Solis, Santa Ana, CA (US)

( * ) Notice: Subject to any disclaimer, the term of this patent is extended or adjusted under 35 U.S.C. 154(b) by 0 days.

(21) Appl. No.: 09/749,070

(22) Filed: Dec. 27, 2000

(65) Prior Publication Data

US 2002/0134296 A1 Sep. 26, 2002

Related U.S. Application Data

(60) Provisional application No. 60/173,276, filed on Dec. 28, 1999.

(51) Int. Cl.[7] ..... B63B 7/00

(52) U.S. Cl. ..... 114/345; 114/71

(58) Field of Search ..... 114/345, 71, 361, 114/343

(56) References Cited

U.S. PATENT DOCUMENTS

| | | | | | |
|---|---|---|---|---|---|
| 4,745,860 | A | * | 5/1988 | Reymann | 114/345 |
| 5,452,678 | A | * | 9/1995 | Simpkins | 114/361 |
| 5,597,335 | A | * | 1/1997 | Woodland | 114/345 |
| 6,223,677 | B1 | * | 5/2001 | Hall et al. | 114/345 |

FOREIGN PATENT DOCUMENTS

| | | | | |
|---|---|---|---|---|
| CH | 651793 | * | 10/1985 | 114/345 |
| FR | 1482021 | * | 5/1967 | 114/345 |

* cited by examiner

*Primary Examiner*—Stephen Avila

(57) ABSTRACT

An attachment (10) with rigid bridge shelter (14) and rigid perimeter deck runway ($\mathbf{12}_a$) connected at the rear with an aft support platform (26) and with collision protection at the front (28). Attachment also comprising a wheelhouse (16) with windows (24) and support ribs (20) which enable attachment to be secured to floating surface.

10 Claims, 16 Drawing Sheets

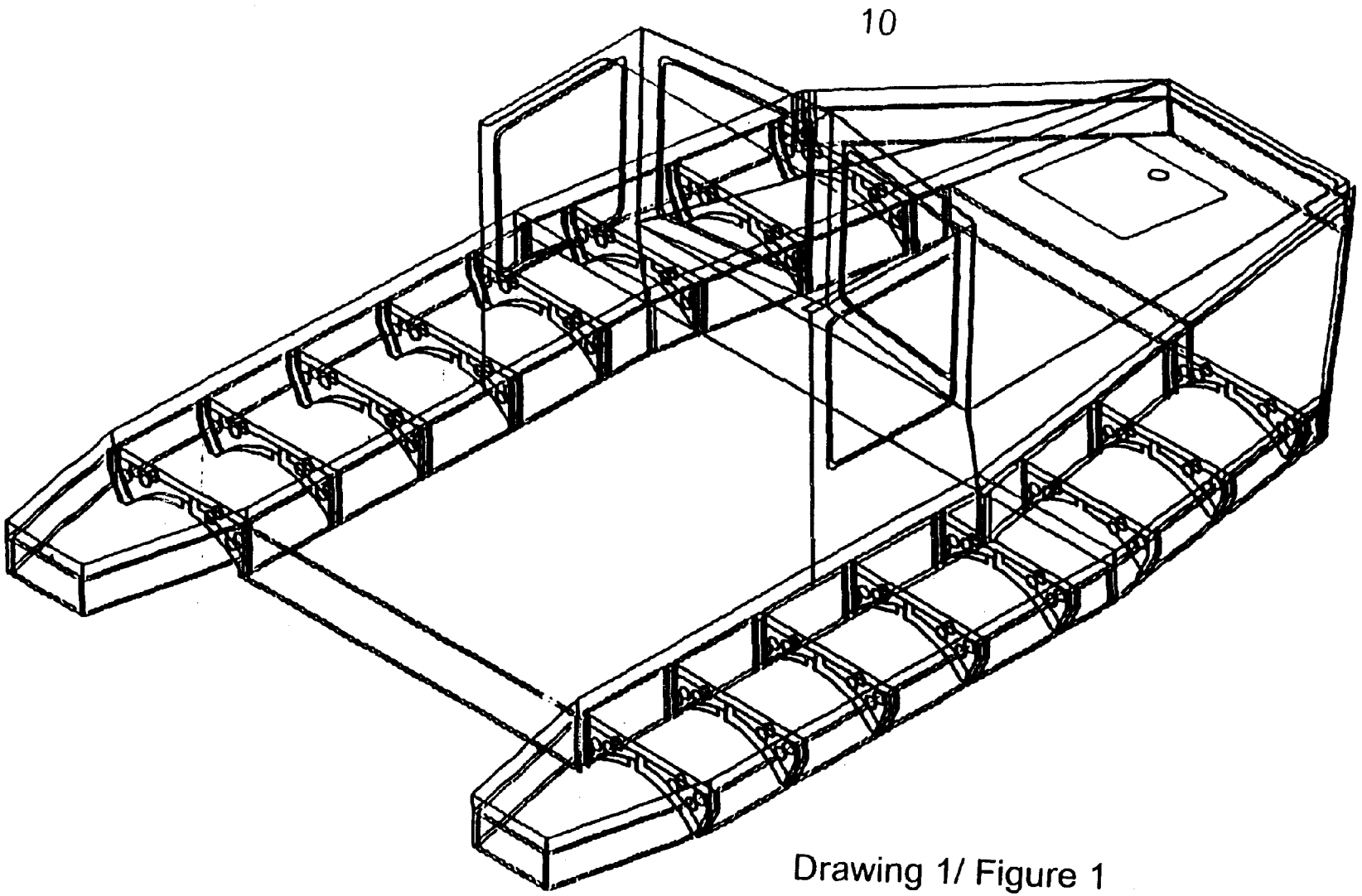
Drawing 1/ Figure 1

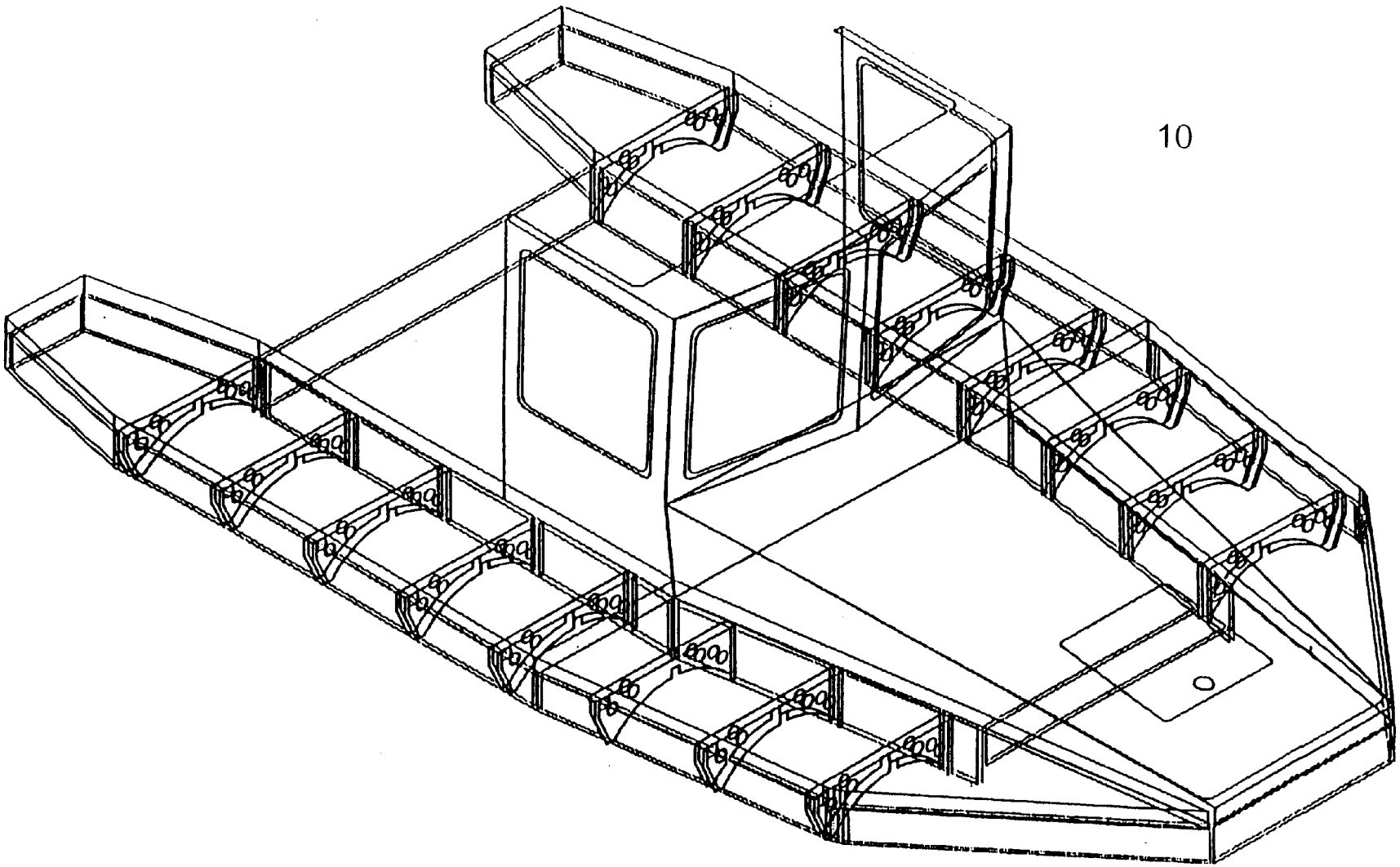
Drawing 2/Figure 2

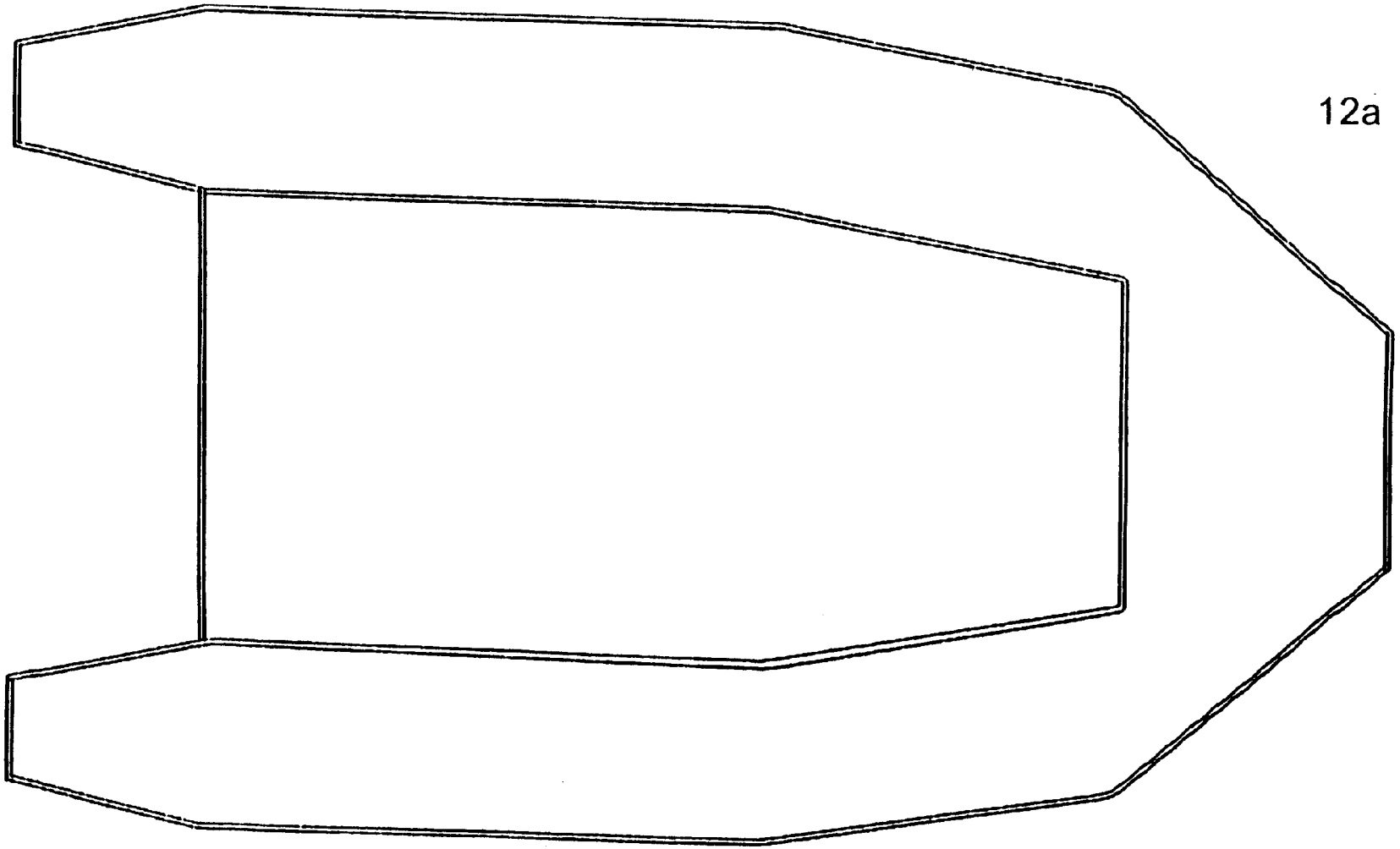
Drawing 3/Figure 3

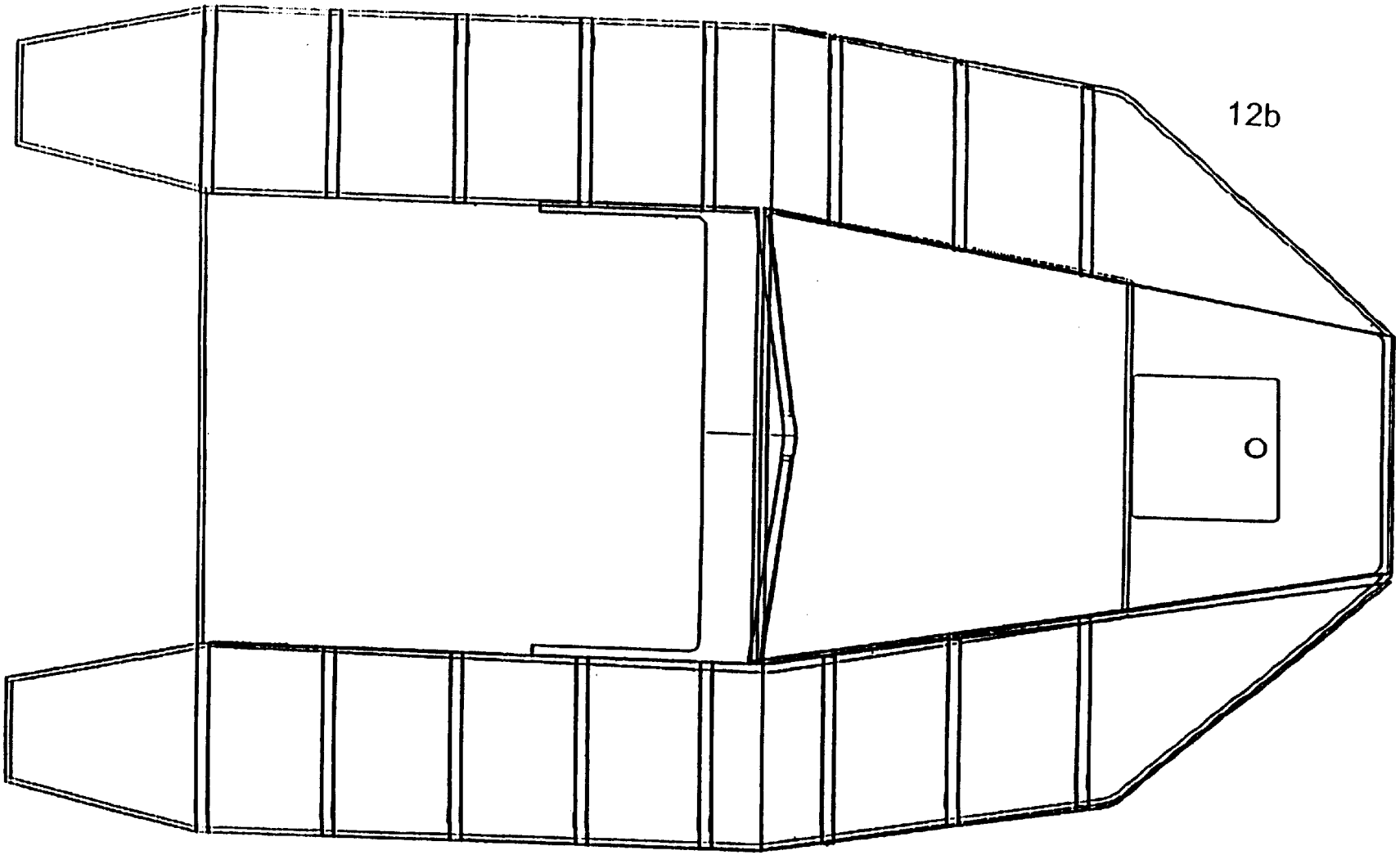
Drawing 4/Figure 4

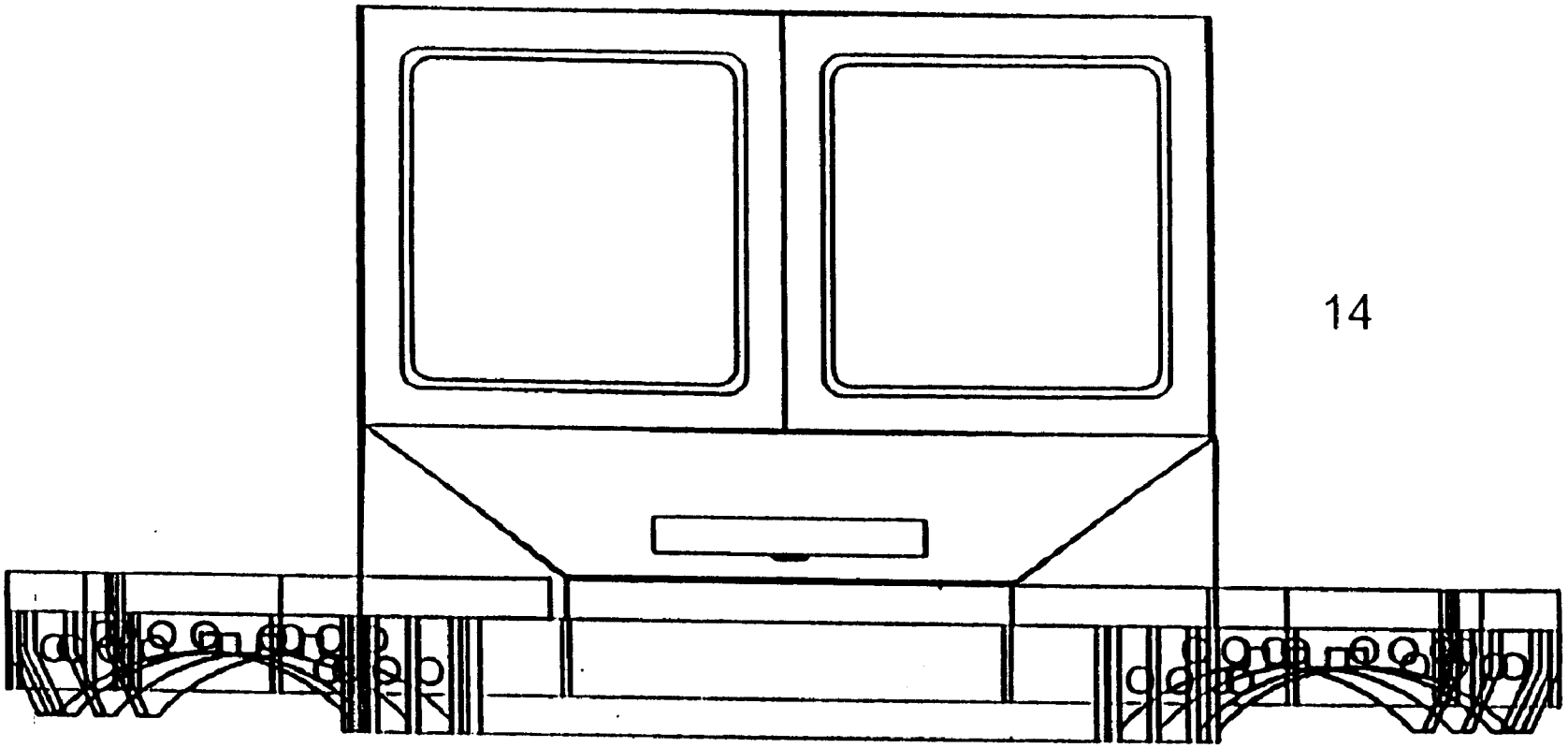
Drawing 5/Figure 5

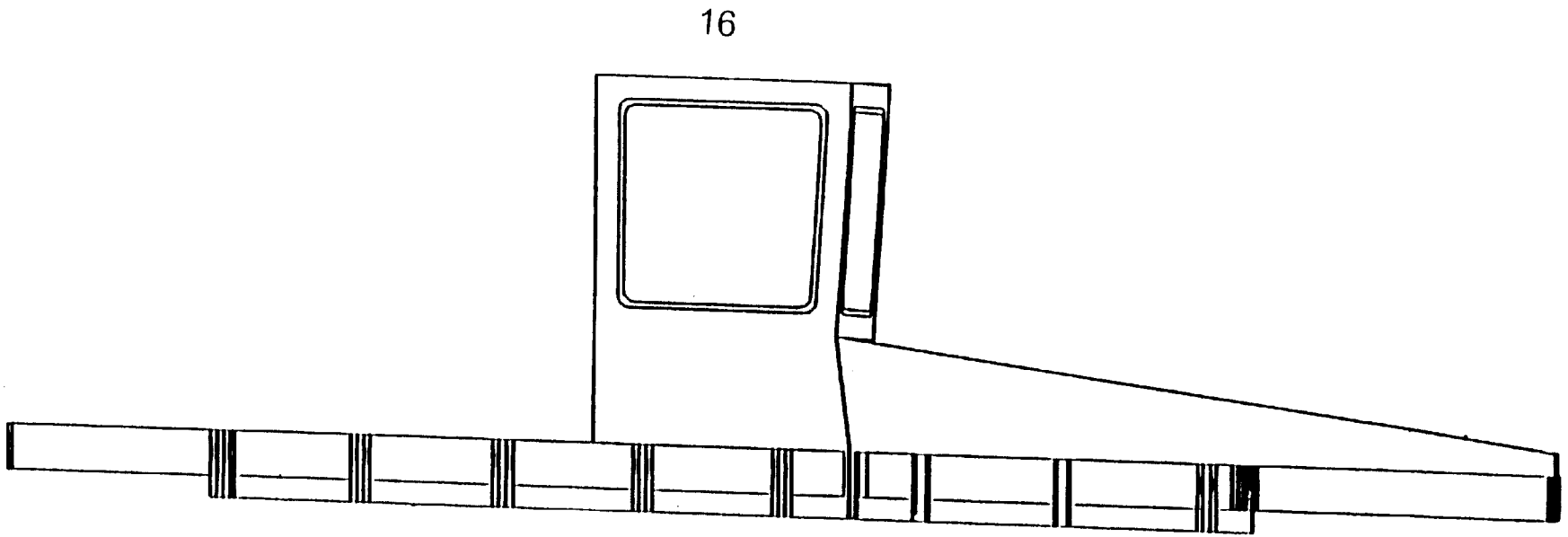
Drawing 6/Figure 6

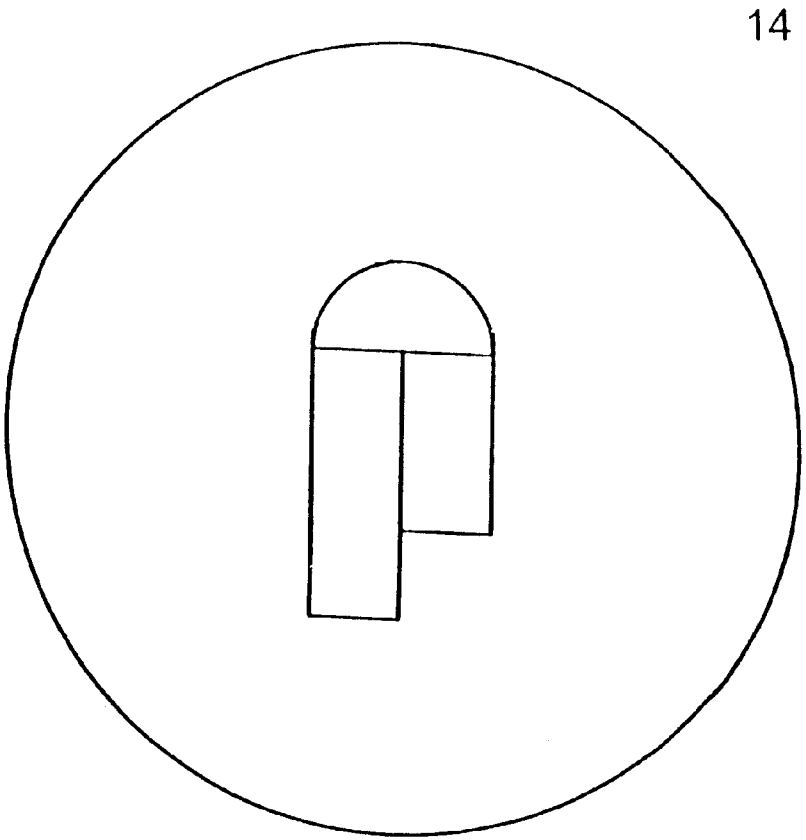
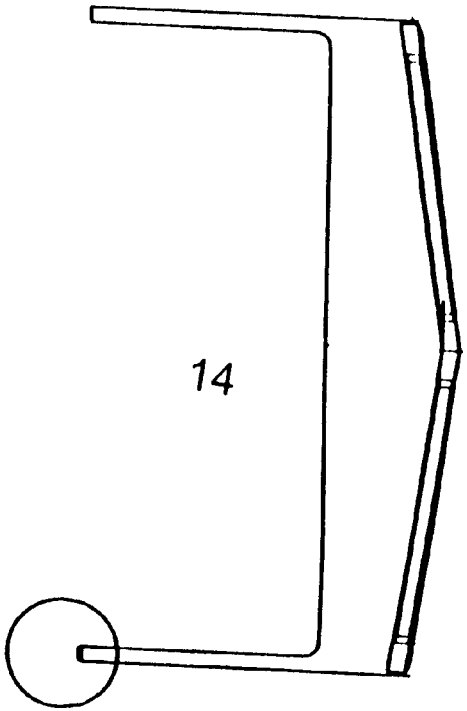
Drawing 7/Figure 7

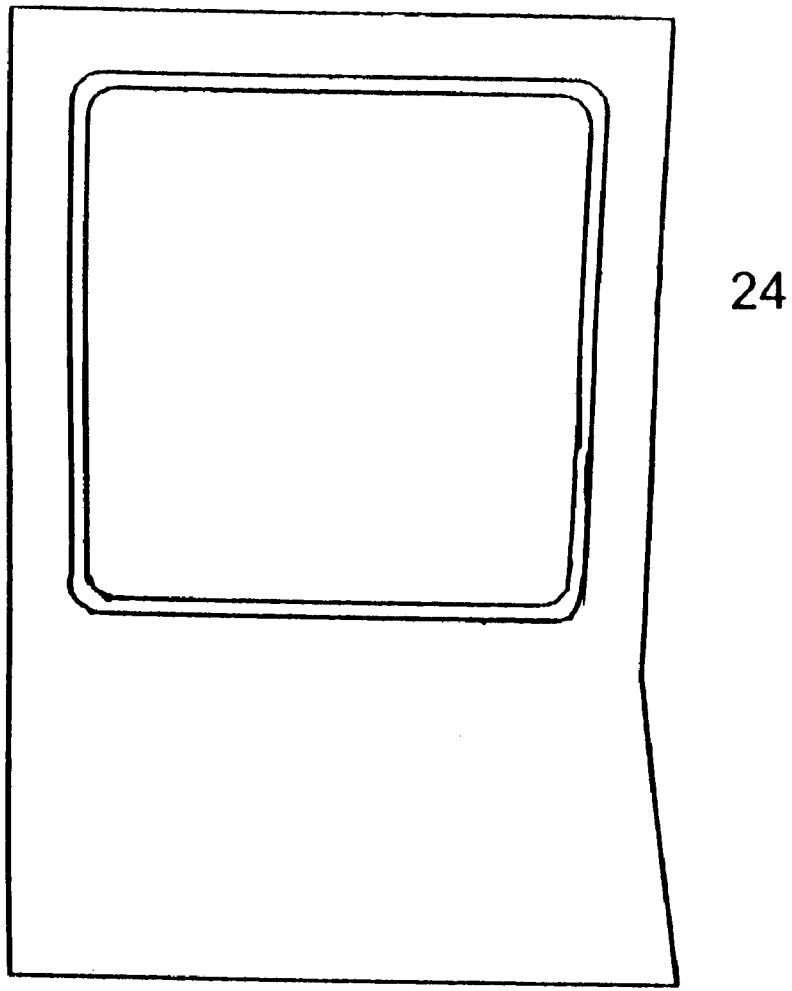
Drawing 8/Figure 8

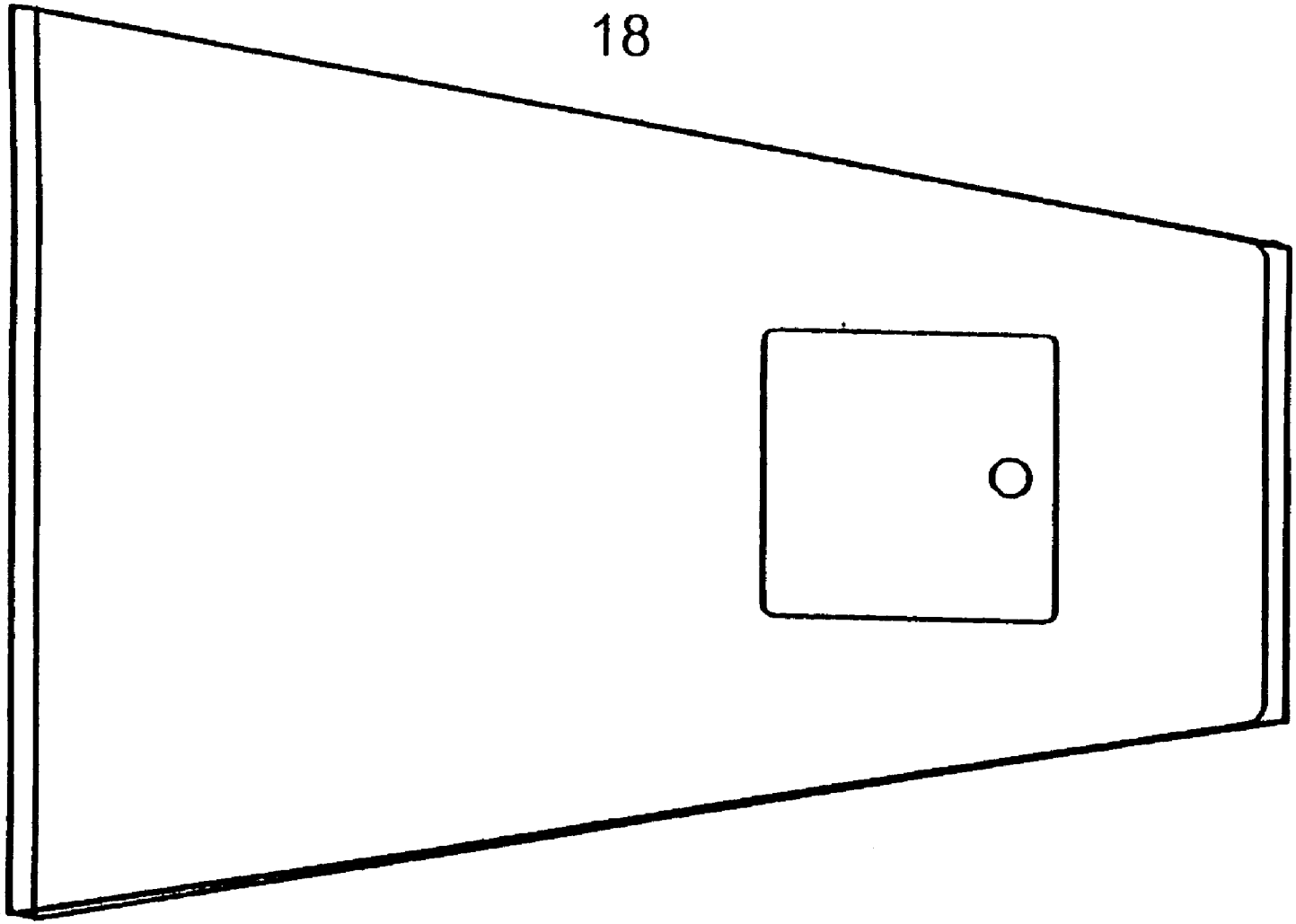
Drawing 9/Figure 9

20
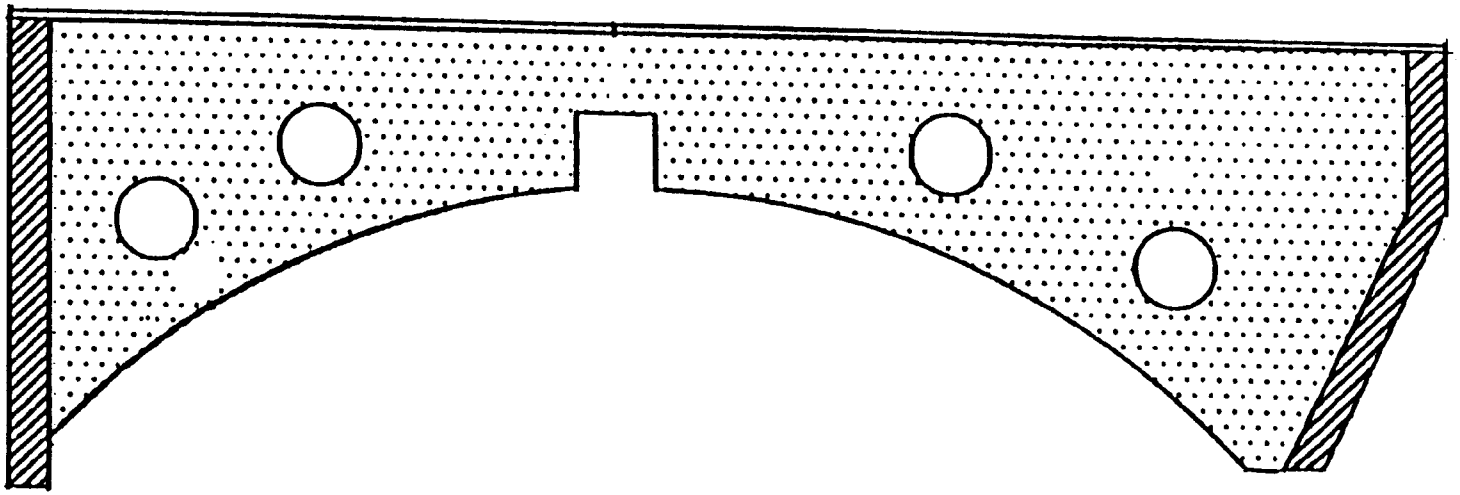
Drawing 10/Figure 10

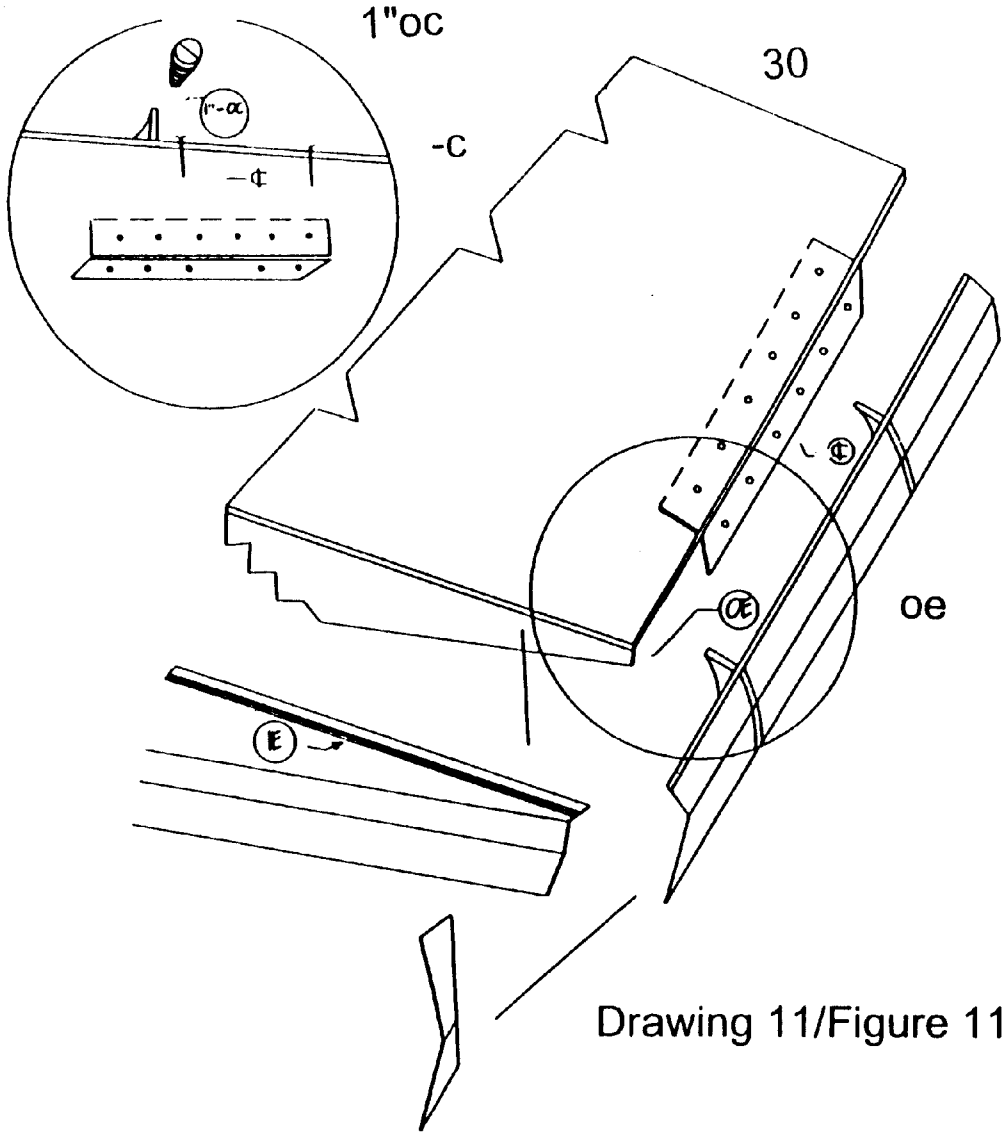
Drawing 11/Figure 11

20
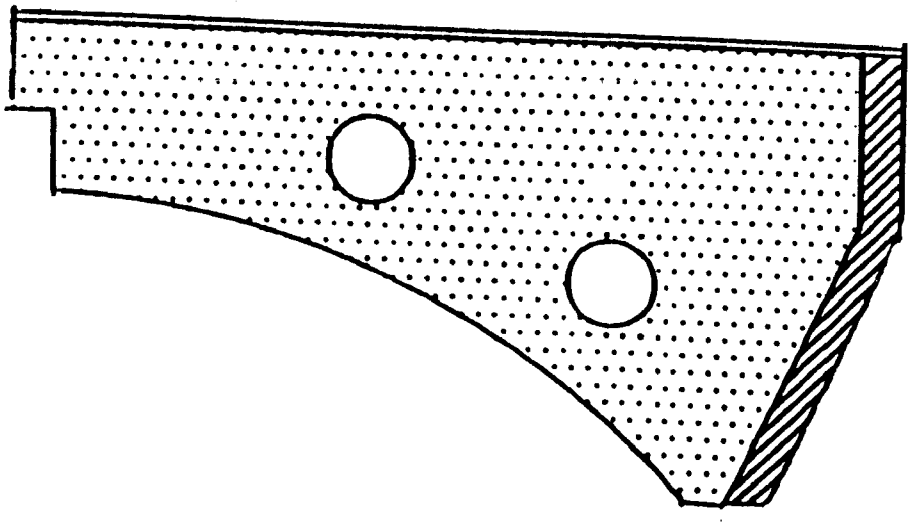
Drawing 12/Figure 12

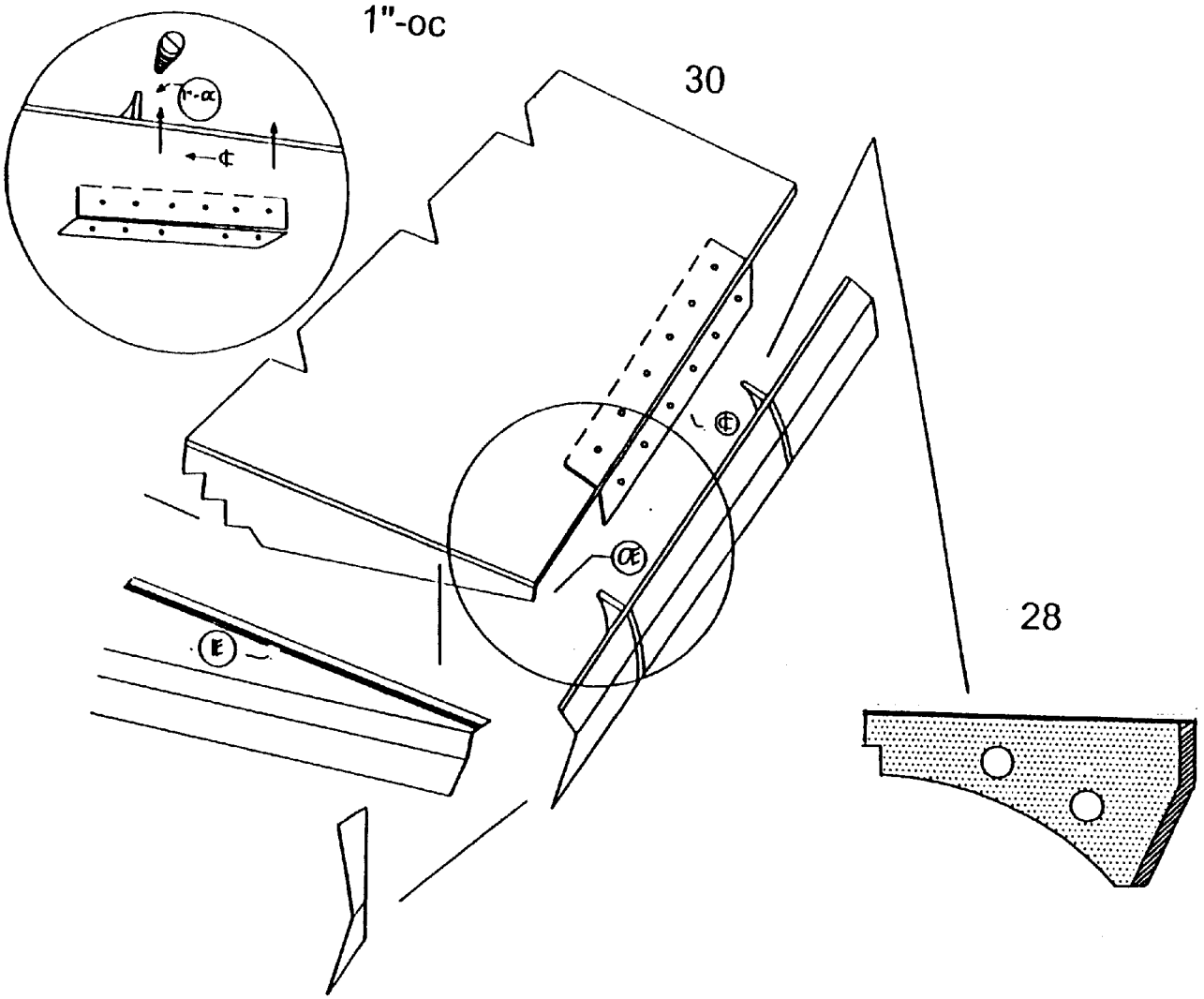
Drawing 13/Figure 13

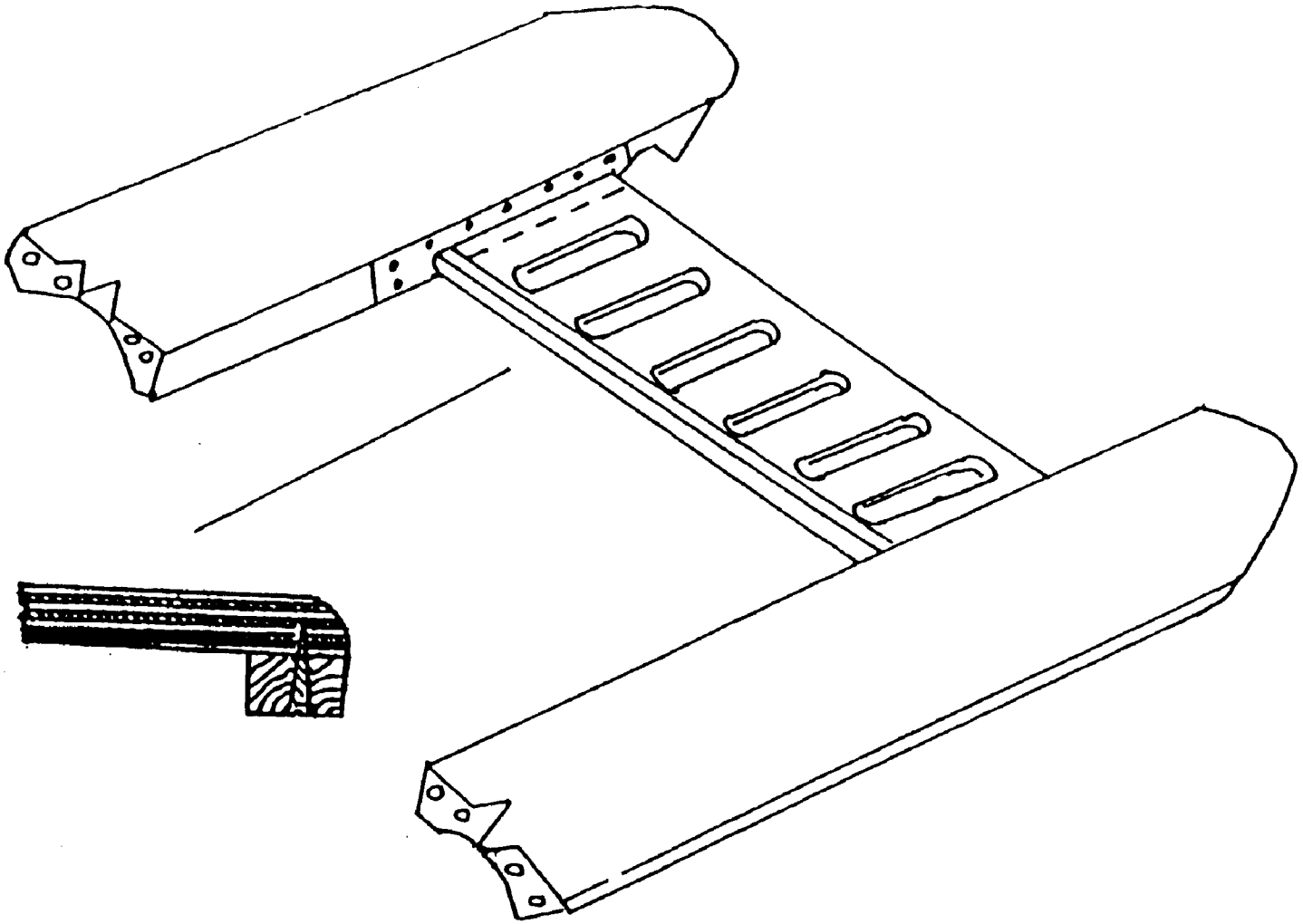
Drawing 14/Figure 14

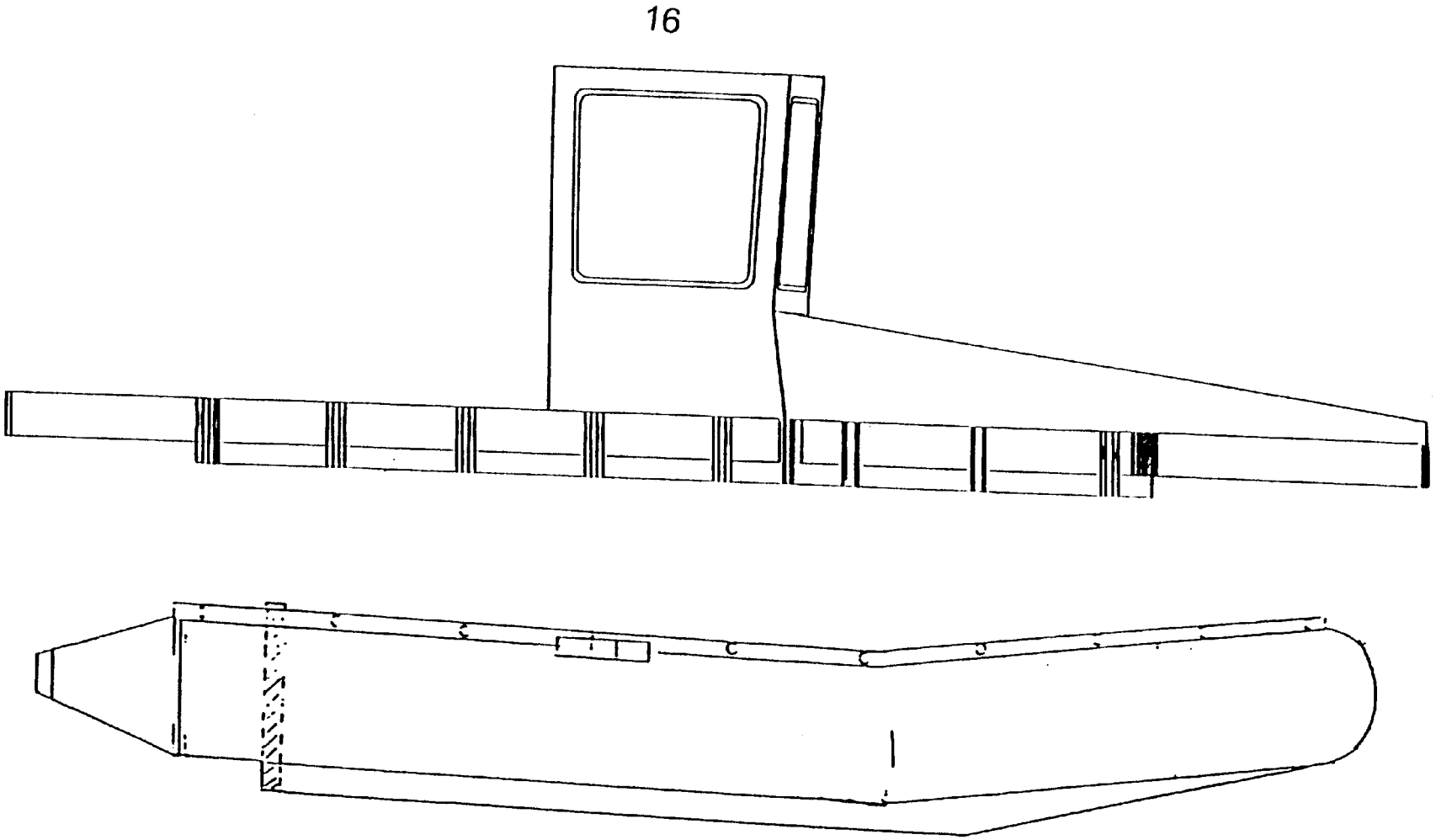
Drawing 15/Figure 15

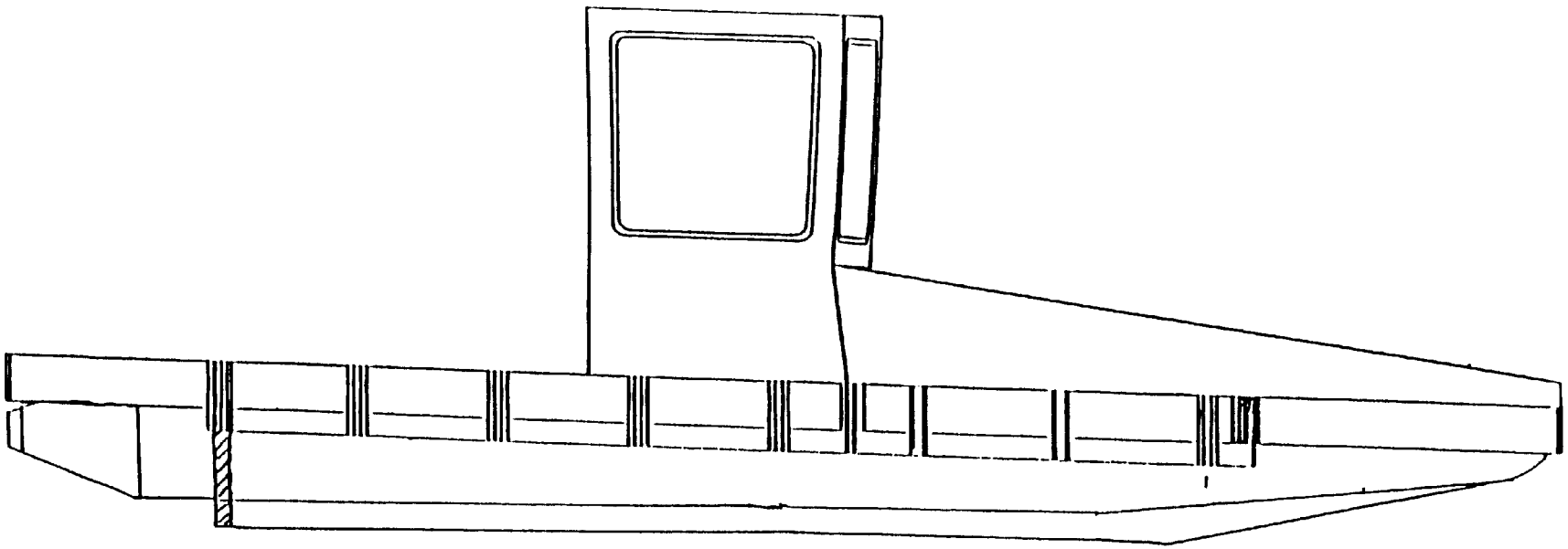
Drawing 16/Figure 16

HARD-TOP DESIGN INFLATABLE WATERCRAFT WITH ASSEMBLY FOR SHELTER AND CIRCUMFERENCE WALKING SUPPORT

This application benefit of 60/173,276, Dec. 28, 1999.

FIELD OF INVENTION

Nautical Accessory, Utility Attachment for Inflatable Boat.

BACKGROUND

Description of Prior Art

Prior Art attachments intended to improve the seaworthiness of inflatable boats have been narrow in scope, limited in their practical utility, poorly constructed or technical, complex and expensive and, for the most part, have failed to significantly increase the seaworthiness of inflatables.

We use the term "Attachment" or "Accessory" to refer to an object or device that is not essential in itself but that adds to the beauty, convience, utility or effectiveness of something else.

The invention disclosed here is a fairly inexpensive, simple piece of equipment, with no moving parts which is optional for inflatable boats and was specifically designed for particular uses. When this attachment was connected to an inflatable, the results were a combination of beneficial effects which were both novel and anticipated and novel and unanticipated.

The review of the prior art will show that the combined effects or results that follow the hook-up or connection of this apparatus to inflatable boats have not been anticipated nor taught by the prior art.

Indeed, a review of the prior art repeatedly shows that those familiar with and skilled in the art have invented around but have not particularly pointed out nor distinctly claimed an attachment that significantly increases the seaworthiness and utility of inflatable boats or creates the combination of improvements this invention creates, when the attachment is connected to an inflatable.

This, of course, indicates that this invention is not obvious at all; further, the combination of results are novel in a variety of ways that are not duplicated and cannot be duplicated by the prior art.

The synergistic effect is more than the sum of the parts of having a hardbody boat on the one hand and an inflatable on the other; neither, by itself, creates this result. The effect is a hybred effect, more than the sum of it's parts, crossing the worlds of higher profile hardbody boats with those of lower profile inflatables, when this attachment is connected to an inflatable.

Indeed, this attachment is well poised for commercial success since it fills a long felt need which has not been addressed by those skilled in the art. Further, it increses the value added at a lower cost than alternative attachments, if any.

The prior art repeatedly teaches and anticipates around this invention but is not on point; if this invention were obvious, the prior art would not teach around it. If those skilled in the Art had thought of this invention they would have invented it by now, therefore this invention must be nonobvious.

The evidence collected here repeatedly shows that the differences between Mr. Stewart's invention and the prior art were not at all obvious and could not have been obvious to those skilled in the art at the time the prior art was made, otherwise the prior art would be more on point.

There are some rough and remote approximations to our invention that include a complete boat or an accessory for a boat but that teach or anticipate around the invention which is the subject of this application e.g. Hiller, U.S. Pat. No. 4,807,556; Garnier-Lock, U.S. Pat. No. 6,186,088 B1; Lewis, U.S. Pat. No. 5,070,807; Harding, U.S. Pat. No. 5,033,434.

With this attachment, we are claiming less not more than the prior art, but what we claim has greater utility not less utility than the prior art, when this attachment is placed on an inflatable. This applies primarily where the prior art claims an entire boat, not an accessory for a boat.

Where we review prior art accessories for inflatable boats, our invention provides suprising and unanticipated results not provided by prior art accessories. These unanticipated results include but are not limited to enhanced overall handeling, balance and performance, when the attachment is connected to the inflatable.

Though Hull et al (U.S. Pat. No. 6,233,677) discloses an inflatable watercraft with pontoons, a rigid deck and a cabin, it is an entire inflatable boat which they claim, as contrasted with an optional, surface accessory, which is the invention claimed by this applicant. We claim less not more; we claim an optional attachment for a boat, not the entire boat itself.

They claim "an adaptable, multipurpose boat", we claim "an attachment for increasing seaworthiness and utility of inflatable boats". The focus of the Hull invention is an embedded hull and the "deck" they refer to is located on what is normally considered the "bridge" of a boat, not the horizontal perimeter circumference of the inflatable which is the location of the "deck" on the accessory described by our invention.

Most prior art described here is using the term "deck" to refer to what is actually the "bridge" area of a boat; we use the term "deck" to refer to a horizontal perimeter plank area which lies at the outermost perimerimeter around the horizontal circumference of a boat, lying on a raised area above the bridge. Not all boats have a deck as we described here; for example boats that are extremely aerodynamic in shape do not have such a deck area, though there may be a lip or ridge there not intended as a deck area. See also Simpkins (U.S. Pat. No. 5,452,687) at #14 for support platform and Garnier-Lock (U.S. Pat. No. 6,186,088 B1) for support base.

The "deck" that Hull et al disclose is not equavilent to the horizontal perimeter plank area described by this applicant when referring to the accessory for inflatable boat. Hull et al do not distinctly claim this circumference perimeter plank area as part of the "deck" area and their invention teaches away from this area and toward the "bridge" location with a primary focus on the recessed, embedded hull construction.

Reymann et al (U.S. Pat. No. 4,745,860) like Hall et al disclose and claim an entire boat, not an accessory for a boat; they are claiming more, we are claiming less. Reymann discloses a hard body toy boat with a round balloon, not a seaworthy pontoon. There are no attachments or accessories which serve to enhance the practical utility of generic inflatable boats.

Reymann et al do not teach nor anticipate significant expanded practical utility applications for their invention, such as expanded usable space and load capacity, as does the Stewart invention. Though both inventions can be used for recreational purposes, these are not comparable inventions.

Simpkins (U.S. Pat. No. 5,452,678) discloses a top for a pontoon boat. He claims the whole boat, though the "boat Top" of his dependent claim is not disclosed as an independent "accessory". Given that this claim is dependent on the independent claim, he is still claiming an entire boat as his invention. Simpkins is claiming more, we are claiming less.

There is no discussion of this boat top being or intended to be particularily seaworthy, nor is there any indication that this boat top is designed to be an easily removeable, detachable or collapsable accessory such as the attachment we have here submitted for a patent.

Rather, the Simpkins claims indicate that this boat top is intended to be a permanent part of the pontoon boat. The Simpkins boat top is not a "deck" area such as the perimeter runway which is particularily pointed out and distinctly claimed by this inventor. Nothing here teaches that this boat top is particularly seaworthy i.e. useful in rough ocean waters on the open sea.

Hull et al, Reymann et al and Simpkins individually and in combination anticipate around and teach away from the Stewart invention, in part, because they disclose as their primary, independent claims, an inflatable boat or pontoon boat as a whole, not an accessory for an inflatable boat.

Further, Reymann et al does not provide a perimeter circumference runway; rather, his disclosure provides a recess on the superstructure at #3 and #7 which is akin to the streamlined, aerodynamic boat refered to in paragraph 18 earlier, where a lip or a ridge can be seen but is not disclosed as a deck area.

This lip or ridge is located where Reymann's superstructure connects to the lower portion of the boat. Again, Simpkins discloses a lip or ridge which functions as a support base (see also, Garner-Lock) for the hard top roof but is itself not part of the hard top roof nor is it claimed or disclosed as a perimerer runway.

Hediger (CH 651,793,A5) provides a flexible top, not a hard top, however this cover provides more protection than the Simpkins "Top" or "roof", though the Hediger invention is not particularily seaworthy, as is the Stewart invention.

The Ugen (U.S. Pat. No. 1,482,021) invention provides a built in cover for the protection of passengers on an inflatable boat; like the other inventions described above, the claim is for a complete boat not an accessory for an inflatable boat.

Woodland (U.S. Pat. No. 5,597,335) discloses a marine rescue vehicle, comprising a complete boat with high technology support equipment. This is evidently a complex and expensive boat whereas our invention is simple, has no electronic or moving parts and is relatively inexpensive.

Other inventions which teach complete boat and are relevant prior art include: inflatable boats which are designed to inflate automatically (Hemphill and Dale U.S. Pat. No. 6,178,911,B1; Shoaff, U.S. Pat. No. 5,800,225), A convertable, inflatable tent-like shelter which can be used on land or water (Odekirk, U.S. Pat. No. 4,766,918), a rigid inflatable boat, disclosed as a number of airfilled bladders attached to a rigid hull (Hiller, U.S. Pat. No. 4,807,556) and a boat cabin enclosure that pivots out and rests on the deck of a hardbody boat (Benson & Kent, U.S. Pat. No. 5,964,173).

These are to name a few more inventions which teach complete boat, not accessory and which anticipate around and away from the invention we have disclosed.

Patented attachments for inflatable boats developed by persons skilled in the art also repeatedly show that inventors have taught around and away from the accessory we claim as our invention, which is novel and nonobvious.

Pestel (U.S. Pat. No. 5,819,682) has invented an assembly for a mixed-hull inflatable boat which can be converted into a closed box. This assembly does not have the features that the Stewart invention has and storage capacity is its primary focus.

Sanburg (U.S. Pat. No. 4,671,203) provides a top for a boat which serves as a duck blind; Lewis (U.S. Pat. No. 5,070,807) provides a temporary canopy for a pontoon boat primarily comprising a soft top cover; Peterson (U.S. Pat. No. 5,564,357) discloses a protective cover for the protection of the inflatable boat itself and Lee (U.S. Pat. No. 5,507,244) discloses an accessory which allows for the mounting of seats on an inflatable boat.

These accessories or attachments teach around the concept of the invention we have developed, and they are not on point and do not anticipate the surprising and novel combination of results that our invention provides.

There is one invention which provides a semirigid surface which serves as a support base for an inflatable boat (Garnier-Locke, U.S. Pat. No. 6,186,088 B1) and a second invention which discloses a rigid deck for an inflatable boat (Harding, U.S. Pat. No. 5,088,434).

These two inventions provide a closer, perhaps the closest, descriptive approxamation to the invention which we have disclosed: they are accessories or attachments for inflatable boats and their purpose is, in part, to transform an otherwise soft and flexible surface into a rigid one with the result that more usable space is created (Harding) and accessories can be firmly attached (Garner-Lock).

The garner-Lock is a plate or pod upon which objects can be firmly affixed. If these plates or pods were placed throughout the outer horizontal perimeter of an inflatable, it is concievable that they would form a deck or perimeter runway; or if these plates or pods were wide and long that they could serve as a deck or runway for an inflatable boat.

The Garner-Lock invention claims that it is a support base upon which other accessories can be affixed; our invention, of course, also claims this.

One fundamental difference, though is that our invention provides a broader scope of applications and creates a unique combination of results not limited in scope by being a "plane" (a flat object) which Garner-Lock have invented. For example, Garner-Lock do not teach nor anticipate a bridge shelter or cabin or wheel house or collision protections, as we propose.

The harding invention (U.S. Pat. No. 5,088,434) is also primarily a plane—a flat straight object, and suffers from the same fundamental differences as the garner-Lock invention when compared to our accessory attachment. Specifically, it does not teach nor anticipate a bridge shelter or cabin or wheel house or collision protections, as we propose.

Harding discloses his invention as an "inflatable boat and a deck therefore"; this is a rigid, removable "Deck" with a flexible bebow mechanism that also serves as a connecting joint for these elements which are place parallel on the "Bridge" or floor area of the inflatable.

Harding refers to his invention as a deck for an inflatable boat; Our claims distinguish between a "deck" (horizontal perimeter runway) and a "Bridge" (the center most, flat, recessed area of the inflatable), each being located at different areas of the boat.

Hardings' invention was not intended for and teaches away from the area we call a horizontal perimeter runway since there are no supporting mechanisms to hold this invention in place if it were intended to be located on the uppermost curvature surface of the pontoon.

Harding has disclosed floorboards for the bridge area; the Stewart invention has nothing to do with floor boards. It is, though, concievable that some of Harding's floor boards could somehow be strapped on the upper curvature of the pontoon and function as a runway; however, this would be a far-fetched claim and would overreach any fair interpretation of what may have been anticipated by harding. (see also Hart, U.S. Pat. No. 4,807,555).

Nevertheless, the Garner-Lock and Harding inventions are fairly recent (1997 & 1990) and indicate a long standing need for an attachment which can transform a flexible, inflated surface into a rigid surface upon which objects can be firmly affixed.

These two inventions are more on point than other prior art that claim an entire boat as the invention; Indeed, the focus of the Garner-Lock and Harding attachments are much more along the lines of the concept we claim: an attachment for an inflatable upon which accessories can be affixed.

These two inventions, however, do not teach nor anticipate a bridge shelter (cabin) nor do they create the novel and surprising results that our invention has on the handeling, balance and performance of the inflatable, when the attachment is connected.

Consider placing a shell or camper on a pick-up truck; the truck is transformed into an R.V., recrational Vehicle with a shelter. Consider the effect that a simple bar or bridge on the rear of a car can have on the overall performance of the vehicle—we call these "spoilers".

Likewise, the simple fact of having the accessory attachment we have invented, placed on an inflatable results in novel and unexpected results which go beyond the other practical applications for which the accessory was initially invented.

These are novel and unexpected results which have not been taught nor anticipated by persons skilled in the art. Prior inventions have taught around and have not been on point nor have they created the unique combination of results that our invention provides.

The disadvantages of the prior art include:

A) the lack of seaworthy attachments, accessories or equipment that serve as a horizintal perimeter runway capable of significantly increasing the usable space on inflatables while enhancing the overall handeling, balance and performance of an inflatable, when the attachment is connected to the inflatable.

B) The lack of seaworthy attachments, accessories or equipment that serve as a bridge shelter capable of significantly increasing the usable space on inflatables while enhancing the overall handeling, balance and performance of an inflatable, when the attachment is connected to the inflatable.

C) The lack of seaworthy attachments, accessories or equipment that have the novel result of combining desirable features of hardbody boats with desirable features of inflatables, when the attachment is connected to the inflatable.

D) The prior art teaches either a complete boat as the invention or accessory attachments, neither of which approximate the novel combination of results achieved by the attachment, which is the subject matter of this patent application.

E) The prior art does not teach or anticipate an accessory or attachment that provides a means for making an inflatable significantly more seaworthy, when the attachment is connected to the inflatable.

F) The prior art does not teach or anticipate a simple attachment that increases the value added at a lower cost than alternative attachments, when the attachment is connected to the inflatable.

G) Compared to the invention which is the subject matter of this patent application, the prior art has been limited in scope, poorly constructed, limited in practical utility or technical, complex and expensive and for the most part, has failed to significantly increase the seaworthiness of inflatables with a single attachment.

OBJECTS AND ADVANTAGES

A) This seaworthy attachment serves as a horizontal perimeter runway capable of significantly increasing the usable space and load capacity on inflatables while unexpectedly enhancing the overall handeling, balance and performance of an inflatable, when the attachment is connected to an inflatable.

B) This seaworthy attachment serves as a bridge shelter capable of significantly increasing the usable space on inflatables while unexpetedly enhancing the overall handeling, balance and performance of an inflatable, when the attachment is connected to the inflatable.

C) This seaworthy attachment results in a novel combination of desirable features of hardbody boats with desirable features of inflatables, when the attachment is connected to an inflatable.

D) This seaworthy attachment results in a suprising synergy (combined action/result) that cannot be achieved by a hardbody boat by itself or an inflatable boat by itself or by any other single attachment, when this attachment is connected to the inflatable.

E) This attachment provides a novel means for making an inflatable significantly more seaworthy, when the attachment is connected to the inflatable.

F) This simple attachment increases the value added at a lower cost than alternative attachments, when this attachment is connected to the inflatable. It creates a residual value and prolongs the life of the inflatable which are additional features that will contribute to its commercial success.

G) This seaworthy attachment has a broad practical utility, is well constructed and avoids the technical, the complex and the expenses of other possibly alternative attachments. These are features that will contribute to its commercial success.

Further objects and advantages of our invention will become apparent from a consideration of the drawings and ensuing description.

DRAWINGS AND FIGURES

Drawing 1/FIG. 1: SW Isometric: Cabin front, cabin sides, cabin top support, baseboard, platform construction, starboard, starboard sides.

Drawing 2/FIG. 2: Plan view: cabin front, cabin sides, cabin top support, baseboard, platform construction, starboard, starboard sides, Drawing 3/FIG. 3: rigid deck baseboard.

Drawing 4/FIG. 4: top view cabin: details, cabin front, cabin sides, cabin top.

Drawing 5/FIG. 5: front view—side view: cabin front, cabin sides, cabin top support, baseboard, platform construction, starboard, starboard sides.

Drawing 6/FIG. 6: plan view starboard dimensions: starboard, starboard sides.

Drawing 7/FIG. 7: wheel house top view.

Drawing 8/FIG. 8: window, wheelhouse window.

Drawing 9/FIG. 9: top view, bridge shelter with hatch.

Drawing 10/FIG. 10: detailed rib support: detail.

Drawing 11/FIG. 11: nose cone assembly, collision protection.

Drawing 12/FIG. 12: one-half (½) support rib, detail for collision protection.

Drawing 13/FIG. 13: nose cone assembly, collision protection, nose cone support rib.

Drawing 14/FIG. 14: Aft support platform, detail.

FIGS. 15/16 and 16/16 of the Specification of record are not part of this substitute specification.

REFERENCE NUMERALS IN DRAWINGS

10. Attachment with rigid bridge shelter and rigid perimeter runway deck for inflatable boat.
$12_a$: Rigid perimeter deck runway.
$12_b$: Rigid perimeter deck runway with bridge shelter.
14. Rigid bridge shelter.
16. Wheelhouse (part of cabin).
18. Rigid bridge shelter with hatch.
20. Support rib.
22. N.A.
24. Wheelhouse window.
26. Aft support platform.
28. Collision protection support rib (½ of support rib).
30. Collision protection.
reference numerals end at #30.

SUMMARY

The present invention is an attachment for increasing the seaworthiness of inflatable boats, which equips an inflatable with a bridge shelter and a horizontal perimeter runway, resulting in significantly more usable space and load capacity while enhancing the overall handeling, balance and performance, when the attachment is connected to the inflatable.

DESCRIPTION

FIGS. 1 to 14

FIG. 1 discloses a drawing of a typical embodiment of the present invention 10 which is an attachment with a bridge shelter and perimeter runway for an inflatable boat. This attachment can be made out of a variety of materials ranging from plywood to plastic to other more durable synthetics as well as bullet proof and stealth materials which are difficult to detect by radar. It comprises a perimeter plank runway $12_a$ with a bridge shelter $12_b$. The cabin or bridge shelter is located at the center of the attachment 14 and a wheelhouse 16 is located at one end of the bridge shelter 18 between the perimeter runway $12_a$. The wheelhouse 16 has windows 24 at its front and sides 16 and is open at the stern end though a canopy or cover can be placed here extending aft to the aft support platform 26. The bridge shelter has a hatch 18 which provides access to the shelter or storage area. The attachment is supported by parallel sets of support rib members 20 with concave lower surfaces to engage the upper surface of the flotation. The front of the attachment comprises a nose cone assembly which provides collision protection 30. The attachment comprises an electrical panel (not shown) which enables the attachment to accept most or all accessories found on boats. This attachment significantly increases the seaworthiness and utility of inflatables when connected to an inflatable boat.

FIG. 2 provides an alternate view of the attachment for inflatable.

FIG. 3 shows the horizontal perimeter runway.

FIG. 4 shows the location of the bridge shelter, wheelhouse and perimeter runway.

FIG. 5 shows the front view of the attachment for inflatable.

FIG. 6 shows a side view of the attachment for inflatable.

FIG. 7 shows the top view of the wheelhouse.

FIG. 8 shows the wheelhouse window.

FIG. 9 shows the bridge shelter with a hatch from the top view.

FIG. 10 shows details of the support rib with some dimensions and angles defined, though there is no restriction as to what these angles are, though they should conform to the angles of the particular inflatable the attachment will be placed on.

FIG. 11 shows a nose cone assembly designed to provide collision protections; this includes a hinge, one half of a support rib 12, and a front plate with a rubber gromet between the plate and the front of the attachment.

FIG. 12 shows one half of a support rib which is part of the assembly for collision protection.

FIG. 13 shows detail of the nose cone assembly 30 and designates the location and position of the half support rib 28.

FIG. 14 shows the detail of the aft support platform and the location of its connection to the perimeter runway.

CONCLUSIONS, RAMIFICATIONS, AND SCOPE

The attachment provides significant support for passengers, support for placement of equipment, expands usable space by 60 to 75%, creates greater load capacity, in part, by allowing a more even distribution of the weight. This is caused, in part, by allowing for more places and options to place equipment and passengers. The attachment protects the inflatable from excessive wear, potential rips and tears and from the effects of the sun and salt water. The attachment allows easy access beyond the transom area for accessing the engine(s) or for fishing or rescue purposes. The attachment causes greater control over excessive bounce and lift at the front end, which is a common occurance with most boats and especially with inflatables. The attachment also causes greater stability at the front end at higher speeds and when accelerating, wherein the bridge shelter and perimeter runway contribute to this result.

The attachment provides a durable surface for passengers to safely walk around, also equipment can be placed here and accessories can be permanently secured to this surface.

The nose assembly of the attachment is designed to accept a strong frontal in impact as well as to push or bump objects lose or assist other craft dislodge when imobilized. This collision protection on the attachment has a hinge which effectively distributes the impact away from the main structure of the attachment.

The nose assembly which provides collision protections is not designed nor is it intended to hold the rest of the attachment together, and therefor does not have a direct structural connection with the balance of the attachment.

The attachment contributes to a significant reduction in the amount of moisture exposure by providing cover from spray; it also significantly contributes to the reduction of moisture from condensation. Due to the increased protection and stability that this attachment provides, it has the result of increasing the range comfort and safety of travel on an inflatable, when this attachment is connected.

When the attachment is connected to an inflatable it immediately changes the appearance into what can be described as a striking new appearance with a hearty character.

The attachment is connected to the inflatable by generic, strap-on, break-away belts and turn buckles located around the outer perimeter of the attachment, though other devices can be used to secure the attachment to the inflatable.

The prototype attachment was built using plywood and resin, though the attachment can be built of aluminum, plastic, fiberglass and other durable and composite materials. The best mode of construction is the injection mold procedure.

When the attachment is connected to an inflatable, the vehicle is operated in the same manner as before the attachment was connected, though there will be a significant improvement in the handeling and performance. The skill in use is largely dependent on the experience of the operator.

The scope of applications of this attachment include but are not limited to the recreational, commercial, military, scientific, and emergency. The scope of the invention should be determined by the appended claims and their legal equivalents, rather than by the examples given.

I claim:

1. A seaworthy attachment for an inflatable boat comprising, a rigid deck assembly to overlay a floating surface, the rigid deck having parallel sets of support rib members with concave lower surfaces to engage the upper surface of the flotation, the rigid deck further including a perimeter horizontal plank overlying the frame members to allow a user to walk around the perimeter of the flotation and extending aft of a transom at the stern end, the rigid deck further including a bridge shelter within the perimeter of the rigid deck, the rigid deck further including a rigid wheelhouse cabin enclosure within the perimeter of the rigid deck, the rigid deck further including collision protections having two half support ribs and a storage compartment with a hatch, the seaworthy rigid deck attachment being light weight, collapsable and transportable.

2. The attachment of claim 1 wherein said bridge shelter and perimeter runway contains means for causing a transformation of a generic inflatable into a hybred type watercraft combining advantages of a hardbody boat with those of an inflatable boat, when said attachment is connected to an inflatable.

3. The attachment of claim 1 wherein said bridge shelter and perimeter runway contains means for causing usable space and load capacity to be significantly increased on inflatables while enhancing the overall handeling, balance and performance of an inflatable, where said attachment is connected to an inflatable.

4. The attachment of claim 1 where in said bridge shelter and perimeter runway contains means for causing significant improvements in the seaworthiness and utility of an inflatable, when the attachment is connected to an inflatable.

5. The attachment of claim 1 wherein said bridge shelter and perimeter runway contains means for further increasing the value added at a lower cost than alternative attachments, when the attachment is connected to an inflatable.

6. A seaworthy attachment for an inflatable boat comprising, a rigid bridge assembly to overlay a floating surface, the rigid bridge assembly having a rigid deck runway with parallel sets of support rib members with concave lower surfaces to engage the upper surface of the flotation, the rigid bridge assembly further including a rigid perimeter horizontal deck runway overlying the frame members to allow the user to walk around the perimeter of the flotation and extending aft of the transom at the stern end, the rigid bridge assembly further including a rigid bridge shelter within the perimeter of the rigid deck runway, the rigid bridge assembly further including a rigid wheelhouse cabin enclosure within the perimeter of the rigid deck runway, the rigid bridge assembly further including an electrical panel, the rigid bridge assembly further including collision protections having two half support ribs and a storage compartment with a hatch, the seaworthy attachment being lightweight, collapsable and transportable.

7. The attachment of claim 6 wherein said bridge shelter and perimeter runway contains means for causing a transformation of a generic inflatable into a hybred type watercraft combining advantages of a hardbody boat with those of an inflatable boat, when said attachment is connected to an inflatable.

8. The attachment of claim 6 wherein said bridge shelter and perimeter runway contains means for causing usable space and load capacity to be significantly increased on inflatables while enhancing the overall handleing, balance and performance of an inflatable, when said attachment is connected to an inflatable.

9. The attachment of claim 6 where in said bridge shelter and perimeter runway contains means for causing significant improvements in the seaworthiness of an inflatable, when said attachment is connected to an inflatable.

10. The attachment of claim 6 wherein said bridge shelter and perimeter runway contains means for causing the value added to be increased at a lower cost than alternative attachments, when this attachment is connected to an inflatable.

* * * * *